United States Patent [19]

Jones et al.

[11] Patent Number: 4,932,078

[45] Date of Patent: Jun. 12, 1990

[54] UNITIZED GARMENT SYSTEM FOR PARTICULATE CONTROL

[75] Inventors: Robert S. Jones; Deborah E. Henderson, both of Elkton, Md.; Norman A. Street, Wilmington, Del.

[73] Assignee: W. L. Gore & Associates, Inc., Newark, Del.

[21] Appl. No.: 775,137

[22] Filed: Sep. 12, 1985

Related U.S. Application Data

[63] Continuation of Ser. No. 586,296, Mar. 5, 1984, abandoned.

[51] Int. Cl.[5] ..... A41D 13/12

[52] U.S. Cl. ..... 2/70; 2/84; 2/205; 2/243 A; 2/270; 2/DIG. 7

[58] Field of Search ..... 2/2, 2.5, 70, 84, 69.205, 2/69.5, DIG. 7, 270, 243 A; 264/505

[56] References Cited

U.S. PATENT DOCUMENTS

| | | | |
|---|---|---|---|
| 2,390,462 | 12/1945 | Rosenberg | 2/70 |
| 3,547,765 | 12/1970 | Snyder et al. | 2/2 |
| 3,864,757 | 2/1975 | Hortigan | 2/DIG. 7 |
| 3,953,566 | 4/1976 | Gore | 264/505 |
| 4,344,999 | 8/1982 | Gohlike | 2/DIG. 7 |

FOREIGN PATENT DOCUMENTS

| | | | |
|---|---|---|---|
| 2043487 | 3/1972 | Fed. Rep. of Germany | 2/DIG. 7 |
| 0035005 | 2/1982 | Japan | 2/DIG. 7 |
| 2091082 | 7/1982 | United Kingdom | 2/DIG. 7 |

*Primary Examiner*—Harvey C. Hornsby
*Assistant Examiner*—Joseph S. Machuga
*Attorney, Agent, or Firm*—Mortenson & Uebler

[57] ABSTRACT

The invention comprises a unitized system of garments that prevents particulate matter from passing from the body of the person wearing the garments into the surrounding atmosphere or vice versa. Water vapor or other gases such as air are free to pass through the garment fabric which is a laminate of expanded, porous and gas permeable polytetrafluoroethylene (PTFE) bonded to a porous and gas permeable backing material. Particulate matter is blocked by the very fine pores of the garment. The person is totally enclosed in the garments preferably presenting virtually a 100% external surface of nonlinting PTFE, and passage of water vapor or water vapor and air through the laminate is sufficient to allow breathability. In order to make practical putting the garment on and taking it off, and to eliminate gaps in the garment, separate pieces are required and particulate-proof barriers are required where the separate sections are joined. To ensure the integrity of the total system, high quality jointing is required at every junction between every separate garment piece. The jointing material is preferably a laminate of elastomeric, expanded PTFE and a stretch fabric. Where the face or eyes must be exposed, a separate head and breathable face and/or beard and neck cover is provided.

10 Claims, 5 Drawing Sheets

UNITIZED GARMENT SYSTEM FOR PARTICULATE CONTROL

CROSS-REFERENCE TO RELATED APPLICATION

This application is a continuation of U.S. patent application Ser. No. 06/586,296, filed Mar. 5, 1984 now abandoned.

BACKGROUND OF THE INVENTION

This invention relates to garments which prevent particulate matter from passing from the body of the wearer into the surrounding atmosphere and vice versa.

Conventional particulate control garments generally do not totally enclose the wearer and particulates can escape through openings in the fabric or gaps in the garment. Such garments are not usually complete systems with regard to particulate release, and this is a prime consideration in both clean room and contaminated environments. Although the garment fabric itself may release few particles, the movements of the wearer inside the garment has caused particulate-laden air to exhaust from inside the garment into the clean room atmosphere through gaps in the garment such as the openings at wrists, neck, ankles, waist or place of entry by the wearer. For example, it has been shown that even if the only opening is a high quality zip fastener, the wearer being otherwise encased in an impractical plastic bag, then particulate-laden air will continue to be discharged through the teeth and ends of the zip fastener whenever the wearer moves. Problems also arise when the conventional garment is manufactured of porous materials to allow a degree of comfort to the wearer. However, porous openings in the fabric often allow particles to escape and contaminate the environment and vice versa.

The nominal pore size of standard particulate control garments can be determined by the bubble point method (ASTM No. F316-80) or microscopic examination to be between about 6 and 66 microns (Chart 1) and the average filtration efficiencies, calculated using a laser based spectrophotometer and a NaCl challenge aerosol, are between about 7.75 and 78.57% at 0.1 microns (Chart 2). Many conventional garment materials, especially face and head coverings, actually contribute directly to the particulate problem in a clean room due to linting and their tendency to tear, thus releasing particles.

There are few materials available which do not shed particles and still allow filtered air passage. This fact, coupled with the design deficiencies in most garments, has hindered the development of a truly effective particulate controlling garment. The lack of a total unitized system for particulate control has forced users to assemble a series of unrelated garments such as overalls, goggles, face masks, caps, and so on, into as complete a system as is desired to achieve the necessary degree of particulate control. Such an improvised system is common in both clean rooms and contaminated environments, and is often both inefficient, untidy and uncomfortable.

SUMMARY OF THE INVENTION

A unitized garment system is provided for preventing the entry or exit of particulate matter from the environment to the wearer, and vice versa. The system comprises head enclosure means, body enclosure means, hand enclosure means and foot enclosure means, wherein each enclosure means wherever jointed to adjacent enclosure means is jointed to the adjacent enclosure means by a cuff of an elastomeric laminated material which overlaps a similar cuff of an elastomeric laminated material on the adjacent enclosure means. All exposed external surfaces preferably comprise porous, expanded PTFE material. Each cuff is preferably made of a laminate comprising expanded, porous PTFE bonded to an elastomeric textile fabric or is made of a laminate comprising a composite laminate of porous, expanded PTFE and a polyether-polyurethane bonded to an elastomeric textile fabric. The head enclosure means can comprise a hood which completely encloses the head of the wearer, the hood having a transparent panel therein for visibility, or the head enclosure means can comprise a hood having an opening therein which partly exposes the face of the wearer, the opening preferably having edges which contact the face of the wearer made of the elastomeric laminated material, thereby providing a seal at the edges. The head enclosure means can also be a face mask and a cap.

Figure 1:
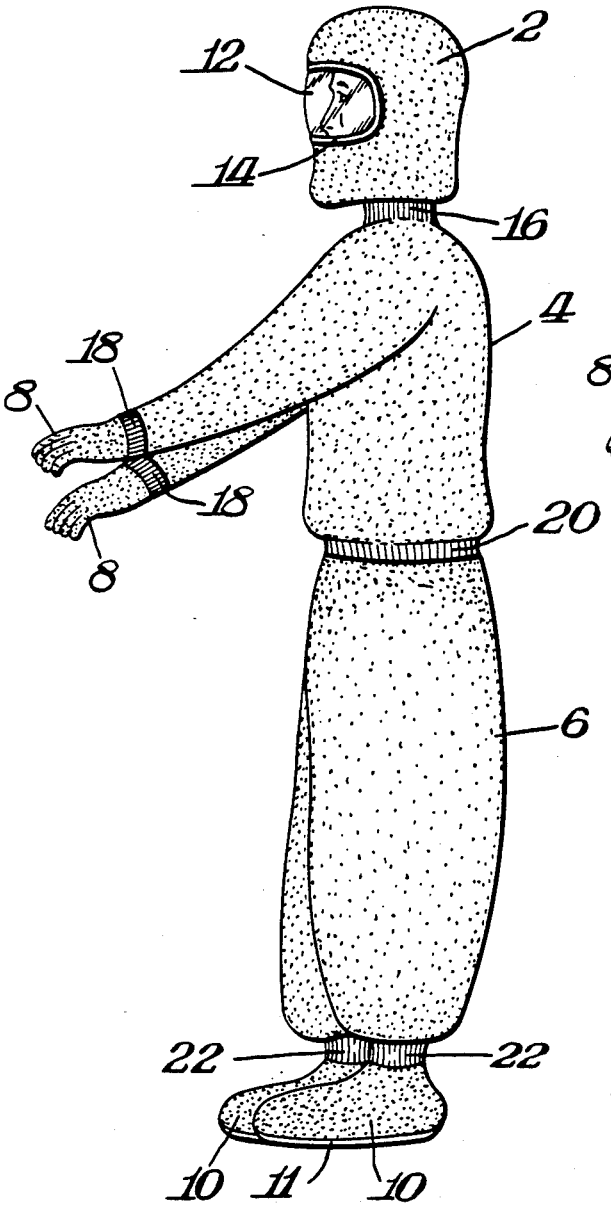
FIG. 1 is an overall pictorial view of the unitized garment of this invention.

DETAILED DESCRIPTION OF THE INVENTION AND PREFERRED EMBODIMENTS WITH REFERENCE TO THE DRAWINGS

The invention comprises a unitized system of garments that prevent particulate matter from passing from the body of the person wearing the garments into the surrounding atmosphere or vice versa. Water vapor or other gases such as air are free to pass through the garment fabric which is a laminate of expanded, porous and gas permeable polytetrafluoroethylene (PTFE) bonded to a porous and gas permeable backing material. Particulate matter is blocked by the very fine pores of the garment. The person is totally enclosed in the garments preferably presenting virtually a 100% external surface of nonlinting PTFE, and passage of water vapor or water vapor and air through the laminate is sufficient to allow breathability. In order to make practical putting the garment on and taking it off, and to eliminate gaps in the garment, separate pieces are required and particulate-proof barriers are required where the separate sections are joined. To ensure the integrity of the total system, high quality jointing is required at every junction between every separate garment piece. The jointing material is preferably a laminate of elastomeric, expanded PTFE and a stretch fabric. Where the face or eyes must be exposed, a separate face and/or beard cover is provided.

The garment system of this invention for particulate control eliminates gaps both within the garments and between the garment units, provides high filtration efficiency of contaminating particles originating from inside or outside the garment while allowing water vapor and/or air passage through the garment, and substantially eliminates shedding of contaminating particles into the environment.

The garment fabric comprises a particulate barrier that is permeable to gases and is comprised of a film of porous, expanded PTFE in which the effective pore size is less than 0.2 microns, calculated by the bubble point method (ASTM No. F316-80) small enough to effectively filter 99.999+% of particles larger than about 0.1 micron from passing through the film. The film is permeable to allow adequate water vapor and air flow through the film providing comfort and breathability to the wearer. This porous, expanded PTFE film is laminated to a base fabric to provide mechanical support. Suitable laminates are available from W. L. Gore & Associates, Inc., Elkton, Md., under the designation GORE-TEX TM two-layer laminates and three-layer laminates. For clean room use, where airborne particles must be at an absolute minimum, the garment may be fabricated with the expanded PTFE film outside and the reinforcing fabric inside against the person wearing the garment. Expanded PTFE film does not shed particles. Alternatively, a three-layer laminate can be employed as a similar particulate barrier in situations where an outer fabric is required for more abrasion resistance. Whether the expanded PTFE film or a reinforcing fabric is outside, the PTFE film provides the key to breathability, comfort and a high degree of particulate control.

To insure that the garment does not gap at openings of the garments, an elastomeric two- or three-layer laminate is preferably provided, in the form of a closely fitting cuff, used at each of the openings in clean room garments. At each such opening, the cuff of one garment preferably overlaps the cuff of the adjacent garment. An excellent junction is achieved when the cuff of one garment overlaps the cuff of the adjacent garment. These cuffs preferably have elastomeric, expanded, porous PTFE membrane on both the outside and inside so that when they are overlapped and pressed together by the elastomeric laminate employed, an excellent, dust-tight, non-shedding joint is provided. The inside surface of the cuff also provides a tight joint with the wearer's skin, giving excellent coherence to the garment and permitting the total garment to confine the wearer's skin flakes, hairs, aerosols and particles shedding from the backing inside the garment concerned. Environmental contaminants are kept outside the garment. The system of garments is intended to totally encase the wearer. The increased effectiveness of this type of joint as compared to garments without cuffs is approximately 500% (Chart 3). Compared to tested garment systems, the increased effectiveness is 15,000% or greater (Chart 3).

The elastomeric two- or three-layer laminate which is preferred for the cuffs of the garments is made by bonding a sheet of expanded, porous PTFE to an elastomeric substrate or by bonding a composite laminate such as is described in U.S. Pat. No. 4,194,041 to an elastomeric substrate as disclosed in pending patent application Ser. No. 443,137. In each case, the layer of porous, expanded PTFE, which does not lint or shed, is oriented externally of the garment. If added external abrasion resistance is required, a third fabric layer can be laminated over the expanded PTFE layer.

The elastomeric substrate can be one of a number of conventional materials, two such being materials marketed by DuPont under the trademarks Lycra® or Spandex®.

When adhesives are used to bond the laminate, exposure to high temperatures for a short time is preferred to permit the adhesive solvent to evaporate quickly, e.g. 150° C. When the composite laminate is used, either adhesive bonding or heat bonding may be employed, the latter being employed to bond the hydrophilic layer of the laminate to the elastomeric substrate.

The elastomeric laminate having an external surface of expanded, porous PTFE can be made by either (1) bonding whichever sheet is used to the substrate, stretching and allowing relaxation, or (2) stretching the substrate and bonding the sheet to the stretched substrate, and then allowing relaxation. So long as the expanded, porous PTFE or the composite laminate is not stretched beyond the point where it fails or tears, an elastomeric laminate having all of the properties of expanded, porous PTFE or the cited composite laminate can be made.

In a continuous process wherein an elastomeric substrate is bonded in a stretched state to a layer of expanded PTFE in an unstretched state, say between continuously rotating rolls, it has been found that treatment of the substrate with Zepel® fluorocarbon water repellent is effective in preventing undesired curling of the laminate.

Substantial stretch of the cuff material is desirable. For example, a minimum 60% stretch for the wrist closures is preferred.

While it is well known to be desirable to use stretch fabrics for collars, cuffs and waistbands of garments, the overlapping elastic cuff closures of this invention for clean room and similar garments are not disclosed nor suggested in the known art.

Anti-static properties can be achieved by using conductive fabrics for the laminates, or by using conductive adhesives for laminating the fabric to the expanded PTFE film, or by treating the garment with standard anti-static agents.

Needle holes made during the sewing of the garments can be covered with a standard heat-sealed tape such as GORE-TEX TM seam tape or by doping the sewn seams with standard polymer solutions such as SEAM-STUFF TM seam sealer, both supplied by W. L. Gore & Associates, Inc., Elkton, Md. Without sealing, fine dust particles may penetrate through needle holes.

Because the laminates used in this application may present a complete PTFE surface to the exterior environment, and because this surface is nonlinting, the combination of elastomeric and non-elastomeric laminates in these clean room garments means that virtually every stitch presented to the clean room atmosphere is PTFE material. External stitching is preferably expanded PTFE sewing thread also available from W. L. Gore & Associates, Inc.; and the use of this thread results in an entire, practical, clean room garment, presenting 100% PTFE surfaces externally, with total non-linting capability to face the related clean room atmospheres.

As indicated above, elastomeric laminates are used in these garments for all cuffs at the edges of every garment piece. There is a minimum cuff length overlap of about ½ inch which, as a practical matter, prevents particulate-laden water vapor or water vapor and air from being released from inside the garment. There is no limit to the maximum amount of overlap used. In the case of clean room pants or sleeve covers, the entire garment piece can be made of this stretch material to suit particular needs.

The use of elastomeric laminates for cuffs is preferably based on a flat pattern shape which is rectangular with concave sides and convex ends. The concave sides are joined to form a hollow tube and this is folded in half longitudinally to make the preferred cuff shape.

One or both cuff edges may then be attached and sealed onto the garment. This cuff shape follows body contours, and enables easier seam sealing.

A shirt unit and pants unit made of the above materials can be made to be loose fitting in order to reduce the number of garment sizes needed for various sized individuals. Garment shapes can be styled or made to be form fitting without detrimental performance (discharge or entry of particulates), provided every opening to the wearer is fitted with the above elastomeric cuff system.

A high degree of protection against particles, aerosol or bacteria discharge or exposure can be achieved by a hood used in conjunction with the garment pieces which totally encloses the head of the wearer and also employs the elastomeric laminate in a cuff or band form to make a neck closure having the properties mentioned above. Because of the high air permeability of the two-layer laminates of this invention employed as the hood material, the hood is breathable and comfortable. The hood (and other garment units) may be used both in clean rooms or in particulate-laden areas to protect the user.

Such a hood has many advantages and is preferred for use where conventional face mask respirators are inadequate. Face masks protect only the respiratory portions of the face. The hood will maintain the entire head and neck area in a clean state, this being particularly important where skin contact with environmental contaminants is a problem. Many face masks do not maintain an adequate seal due to gaps around the nose and cheeks, whereas this hood entirely encloses the wearer's head. The hood eliminates the need for many size masks and alleviates the problem of face fit. When a conventional face mask is required in industrial or laboratory situations, eye protection can also be important, requiring the user to carry goggles as well as a mask. The visor material in the hood can serve as eye protection from particles and liquids and will not allow objects to become embedded in the eyes. Good visibility is provided by the hood having the added advantage of being able to wear the hood over glasses or contact lenses without danger. Facial hair and long hair can detract from the protective qualities of a face mask, but are easily accomodated with such a hood. The hood can be worn in areas where air respirators are normally recommended due to high dust loading, with the benefits of good communications, potential energy savings, comfort and economy.

In some instances, precise visibility may be required, for example, when viewing through a microscope, and limited particulate discharge must be accepted and the wearer's eyes cannot be covered even with a transparent isolating barrier. In this situation, the laminate cuff material, when used as edging to an appropriate pattern, will form a good seal at the edge of the hood material leaving a part of the face exposed as required.

One reason for leaving part of the face exposed is to alleviate the discomfort experienced by many people around their nose and mouth if that area is not permitted free access to the surrounding atmosphere. This exposure has the disadvantage of the associated discharge of particles, aerosols and bacteria from the exposed area in the form of hair and skin flakes, together with the aerosols and bacteria in exhaled breath or, conversely, exposure to environmental contaminants. These discharges can be reduced by the use of various assemblies of goggles, eyeglasses and face masks, but it is exceedingly difficult to achieve the low rates of particle and aerosol discharges required in some clean rooms, such as those involved in electronic or medical work, especially because the facial area is often in close proximity to the work area which will suffer from harm or damage if it is contacted by even very small amounts of particulate matter, aerosols or bacteria. An alternative solution to this problem is to provide a combination of a breathable face or beard cover and cap, or a breathable beard, mouth, nose, and neck cover and cap, all made from expanded PTFE film and suitable backing materials. The cap is edged with a stretchable thread and is fitted with closures in front of both ear locations, consisting of a small patch of elastic rubber or equivalent, attached with adhesive or equivalent. Since each of these closures has a small central hole, it is practical to use regular eyeglasses which are supported by normal earpieces, but particulate matter is prevented from venting into the clean room atmosphere or vice versa. Without these closures, eyeglass earpieces hold the elastic headband away from the head and allow particulate passage.

The cap is conveniently secured to the beard, nose, mouth and neck mask by an attached loop on either side of the head. A button on the mask, set approximately two inches below the elastic edging, permits easy attachment, although other methods of securing cap to mask such as press snaps are also acceptable.

The breathable beard, nose, mouth and neck mask can be made of a two-layer laminate of expanded PTFE and fabric substrate available from W. L. Gore & Associates, Inc. The laminate is permeable enough to provide a Frazier number (cfm/sq.ft. at 0.5" water pressure drop) of ten to forty. This range of air permeability has been shown to allow comfortable passage of air while filtering most particles above 0.1 microns. A minimum of about seven square inches of this breathable laminate is usually required for comfortable breathing. Alternative non-linting materials could be used to make up the remaining area of the mark. The mask is typically made from a flat pattern approximately 32" by 7" (224 sq. inches) before the two ends are sewn together to form the nose, mouth, neck and beard cover section. A stretchable edging is provided in a manner similar to that employed in the cap manufacturing process. The edges, top and bottom, are thereby gathered into a circular shape. When worn, the bottom edge fits snugly around the neck band of the garment suit system, and the top edge fits snugly over the bridge of the nose and around the head. Eyeglasses and cap can then be worn as described above.

For less critical applications, a breathable beard cover and mask can be used which covers the nose, mouth and chin. A stretch edging as described above will hold it tight to the cheeks, chin, and bridge of the nose while the mask is held on the head by a stretchable band.

Alternative face covering designs which would incorporate the non-linting and breathable characteristics of the PTFE membrane include lamination to conventional linting face mask materials such as a polyester web matrix, and to special gas and vapor absorbing or adsorbing mask materials which utilize common adsorptive materials such as activated carbon or molecular seives, or such materials impregnated with a variety of acid, alkali or neutral gas or vapor adsorbing substances incorporated into a linting matrix material. In some specialized cases such materials may be desirable for additional garment segments to provide total protection against toxic environments.

The perceived advantages of these systems compared to conventional beard covers and caps include non-shedding external surfaces, improved retention of hair and skin particles as demonstrated by the increase in filtration efficiency of 100% and increased strength and durability as demonstrated by an increase in tensile strength of greater than 300% (Chart 4) determined by using an Instron tensile tester, which serves to minimize the possibilities of a tear allowing particle release or entry into the particulate controlled environment. Furthermore, if local membranes damage occurs, backup fabric will generally remain and prevent high rates of particle discharge.

Foot coverings are an essential part of a total garment system and, in a similar way, these can be unitized by fitting a cuff elastomeric two-layer laminate at the ankle as mentioned above. This can be important because of the extensive mobility at ankles which causes puffing discharges of particulate-laden air at the top of any boot. An alternative, and preferred, approach is to make the entire upper of the boot of stretchable laminate so that it forms its own cuff by fitting tightly around the wearer's lower shin and above the ankle. This cuff then joints into the cuff of the pants as another part of integrating the unitized system.

Gloves, when made of expanded PTFE film (either by itself of laminated to one or more layers of fabric) have special advantages in clean rooms being non-shedding, highly tactile, non-sweating and having good flexibility characteristics. As in the case of boots, cuffs of stretchable two-layer laminates can prevent particle contaminated venting. The body of the gloves can be made of stretchable two-layer laminate arranged to fit tightly around the wrists to joint over or under the cuff of the adjacent shirt-sleeve in order to complete the closure.

It will be seen from the above description that each of the basic unitized garment pieces has its own integrity with regard to prevention and avoidance of particle release and particle entry. Each piece will joint to adjacent garment pieces with properties appropriate to that part of the person concerned. The total garment system of this invention has no gaps between garment places, excellent particulate filtration efficiency, and a non-shedding outer layer. The total encasement of the wearer is convenient and comfortable, being substantially free of discomfort resulting from sweating owing to the breathability of the laminate material. It is adequately breathable at the face to the extent of supporting natural breathing without serious discomfort.

Anti-static properties can be achieved by using conductive fabrics in the lamination, using conductive adhesives for laminating the fabric to the PTFE film or by treating the garment with standard anti-static agents. The intimate contact with the wearer provided by the tight fitting cuff system allows a path for electrostatic charge to drain away, provided that a ground is made available such as appropriate boot soles or grounded wrist straps. Surprisingly, when single layer membrane gloves are used in this system, electrostatic charges are also drained from their external surfaces due to the effect of the treatment employed in the manufacturing process.

It will be understood that clean rooms are employed for many diverse purposes and, for example, may need only part of the total system described above. It is further understood that these garments offer protection to the user from environmental contaminants such as particulates, aerosols, bacteria and some forms of radiation, and, after the user removes the garments, prevents the transfer of said contaminants outside the work area.

Details of the invention and preferred embodiments are best provided by reference to the accompanying drawings wherein FIG. 1 shows an overall pictorial view of the unitized garment system for particulate control according to the invention. The garment system comprises hood 2, upper body enclosure means 4 in the form of a shirt, lower body enclosure means 6 in the form of pants, gloves 8 and foot enclosure means 10 having, preferably, electroconductive soles 11.

All material external surfaces of this garment, as stated above, are preferably porous, expanded PTFE, except when a fabric overlay is required for external abrasion resistance.

The hood 2 may have transparent visor panel 12 for viewing providing total enclosure of the head of the wearer. The visor is sealed to hood 2 by seal means 14 such as by heat sealing or other means. Neck cuffs 16, wrist cuffs 18, waist cuffs 20 and ankle cuffs 22 are all made of the elastomeric expanded PTFE laminate described above.

The materials used in this garment may be rendered electroconductive by, say, incorporating, conductive carbon powder in the porous, expanded PTFE. Wires may also be employed.

Figure 2:
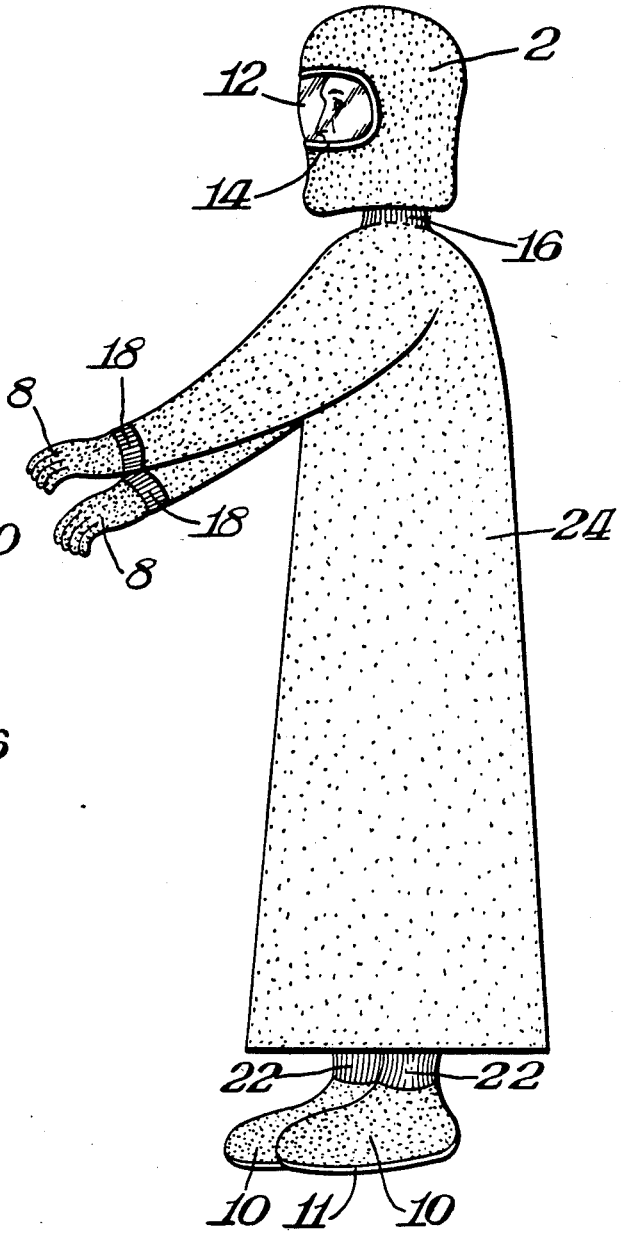
FIG. 2 is a pictorial view of an alternative garment wherein the body covering is in the form of a smock.

An alternative embodiment of a garment for particulate control is shown in FIG. 2, suitable especially in clean room environments wherein air is forced from ceiling ducts vertically downward and conducted through vents in the floor, thereby carrying away particulate matter. The garment comprises smock 24 in assembly with, as before, hood 2, gloves 8 and foot enclosures 10.

Figure 3:
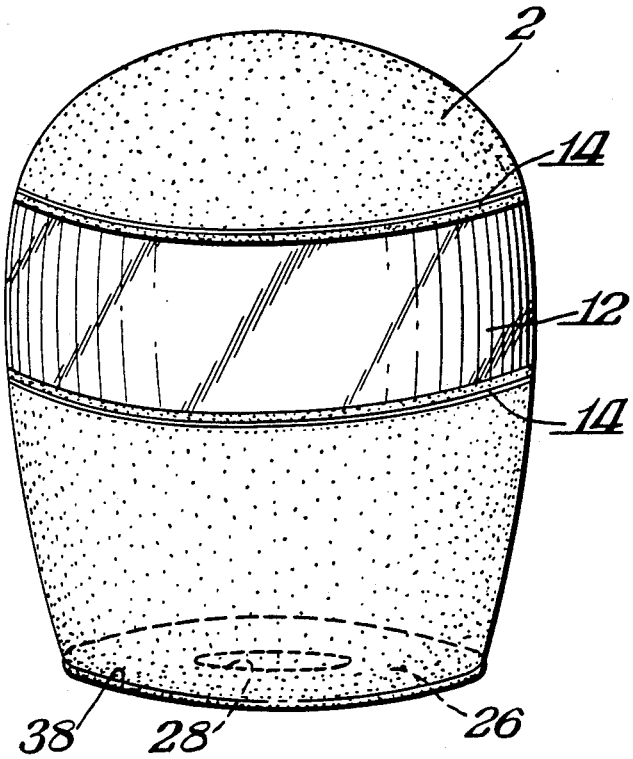
FIG. 3 is a pictorial view of the hood of the invention having a transparent visor.

FIG. 3 shows the details of hood 2 having transparent visor 12 affixed thereto by seal means 14. The neck enclosure means 26 is elastomeric to effect a tight seal at neck opening 28, the enclosure means being sealed to hood 2 by heat seal or other means 38.

Figure 4:
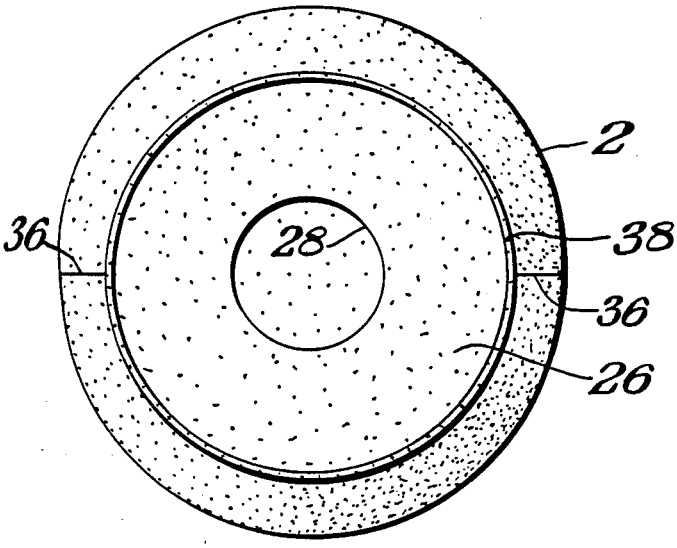
FIG. 4 is a bottom plan view of the hood shown in FIG. 3.

FIG. 4 shows a bottom plan view of the hood 2 with neck enclosure means 26, seams 36, neck opening 28 and seal means 38.

Figure 5:
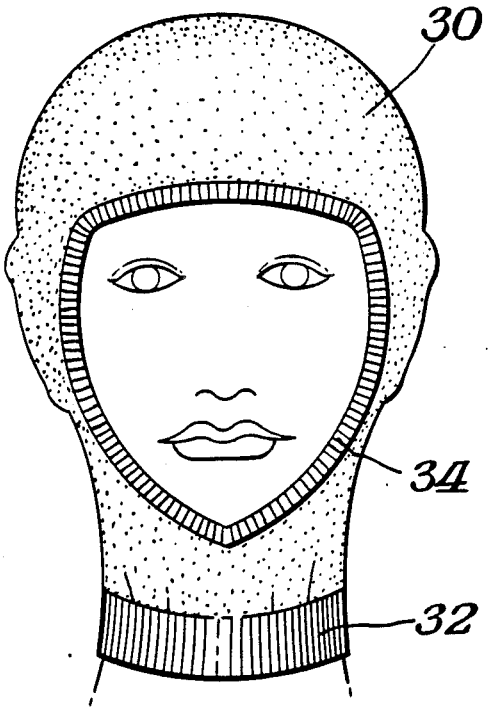
FIG. 5 is a pictorial view of an alternative hood wherein the face of the wearer is uncovered.

FIG. 5 shows an alternative hood 30 wherein the face of the wearer is exposed to the atmosphere. The opening exposing the wearer's face has edges 34 comprising the elastomeric laminate material used for the cuffs described above. This material provides an effective seal at these edges. Hood 30 is provided with neck cuff 32.

Figure 6:
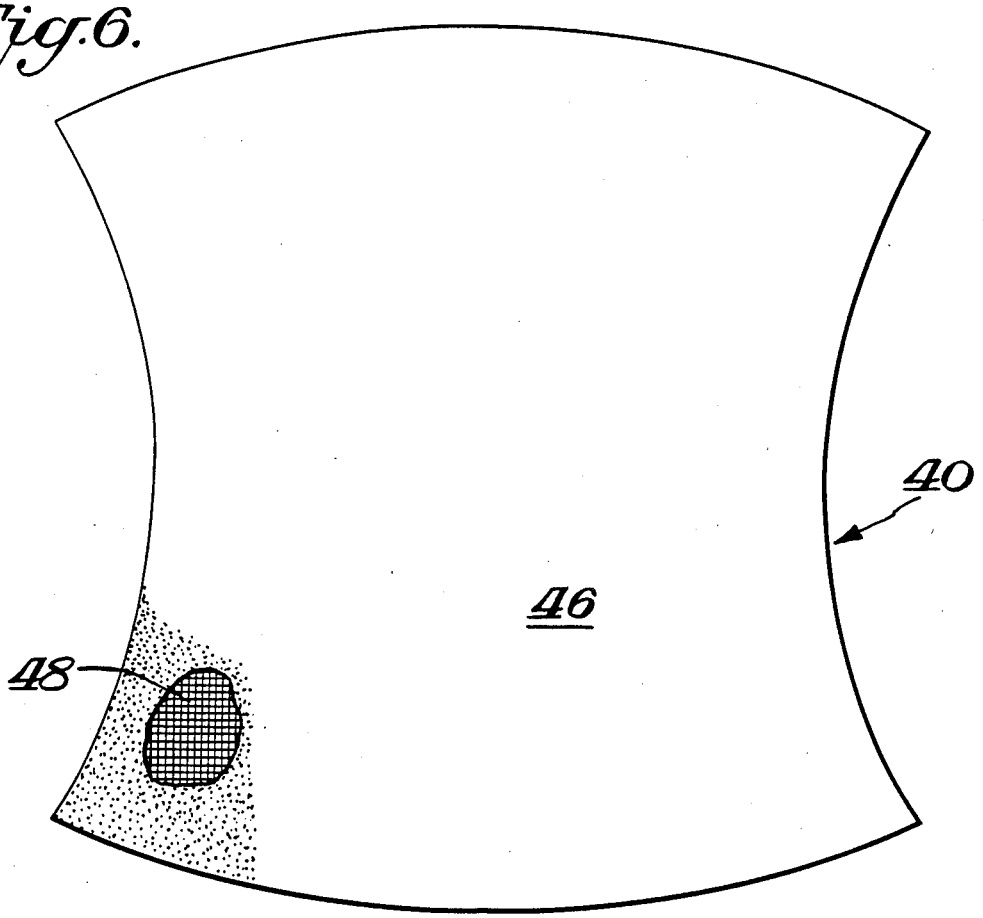
FIG. 6 is a top plan view of the preferred pattern for making the cuffs used in the unitized garment of the invention.

FIG. 6 shows a top plan view of the preferred pattern 40 for making the cuffs of the garment system, wherein expanded, porous PTFE 46 is laminated to an elastomeric substrate 48 shown broken away.

Figure 7:
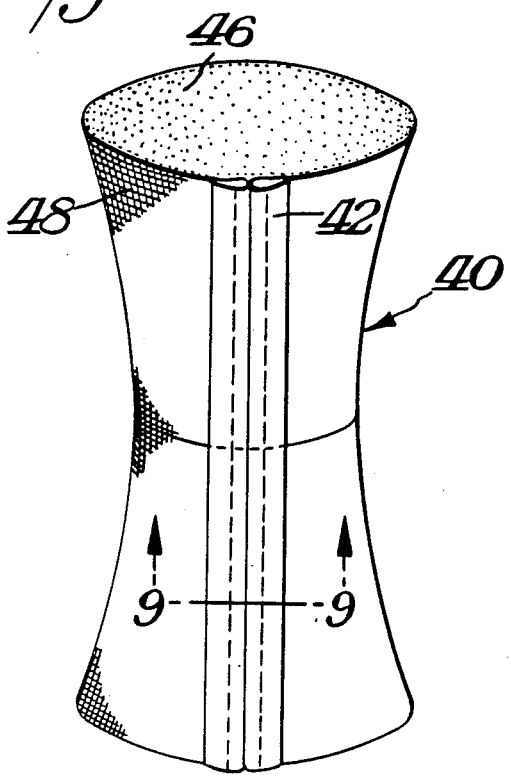
FIGS. 7 and 8 are pictorial views of the cuff assembly in intermediate stages of fabrication.
Figure 8:
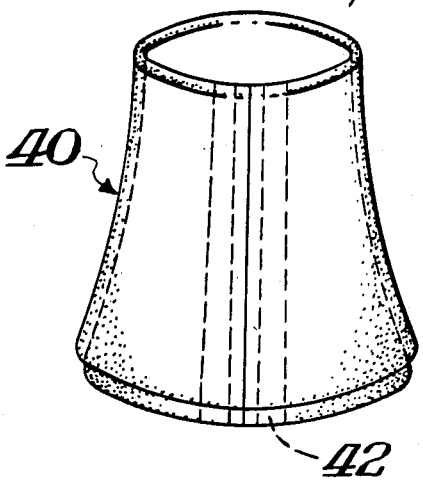

FIGS. 7 and 8 show intermediate stages of cuff manufacture wherein the laminate comprising layers 46 and 48 is sealed at seam 43, after stitching, by means of sealing tape 42, then cuff pattern 40 is folded upon itself forming the structure shown in FIG. 8.

Figure 9:
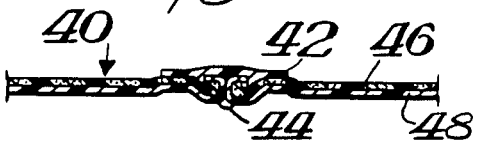
FIG. 9 is a cross-sectional view of the cuff assembly taken along line 9—9 of FIG. 7.

A cross-sectional view of the cuff pattern 40 taken along line 9—9 of FIG. 7 is shown in FIG. 9, wherein laminate 40 of layers 46 and 48 is stitched at seam 43 by stitches 44 and sealed with tape 42.

Figure 10:
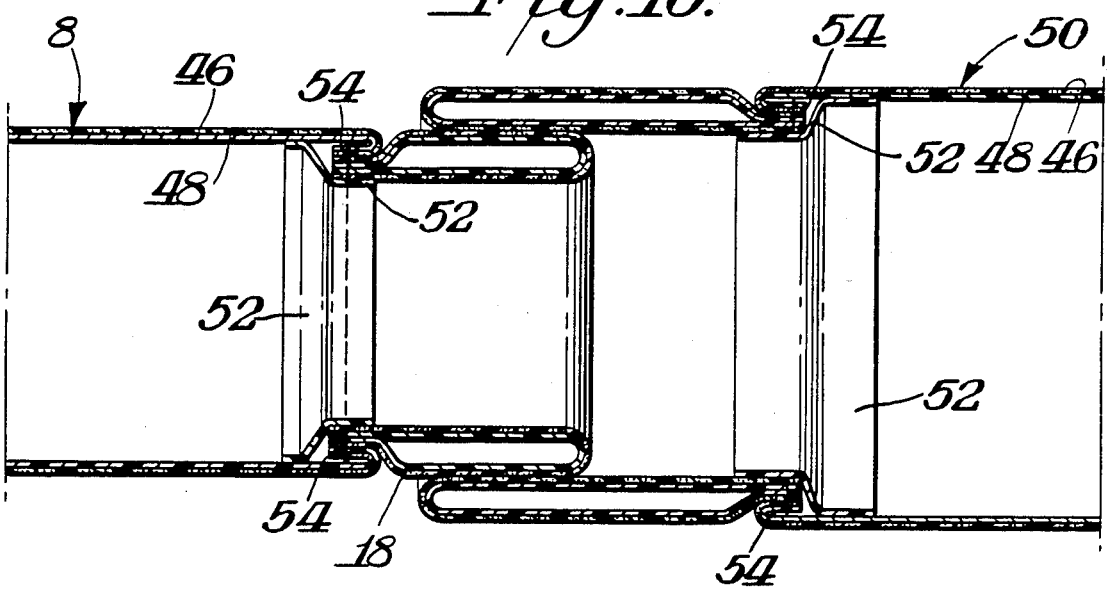
FIG. 10 is a cross-sectional view of mating cuff assemblies according to the invention.

FIG. 10 shows the overlapping cuff means according to this invention, for example at the wrists of the wearer. Therein sleeve laminate 50 comprising layers 46 and 48 is affixed to cuff 19 by means of sealing tape 52 and stitching 54. Similarly, glove material 8 is affixed to glove cuff 18 by means of sealing tape 52 and stitching 54. When cuffs 18 and 19 overlap as shown, the particulate barrier is complete and all exposed surfaces are expanded, porous PTFE.

Figure 11:
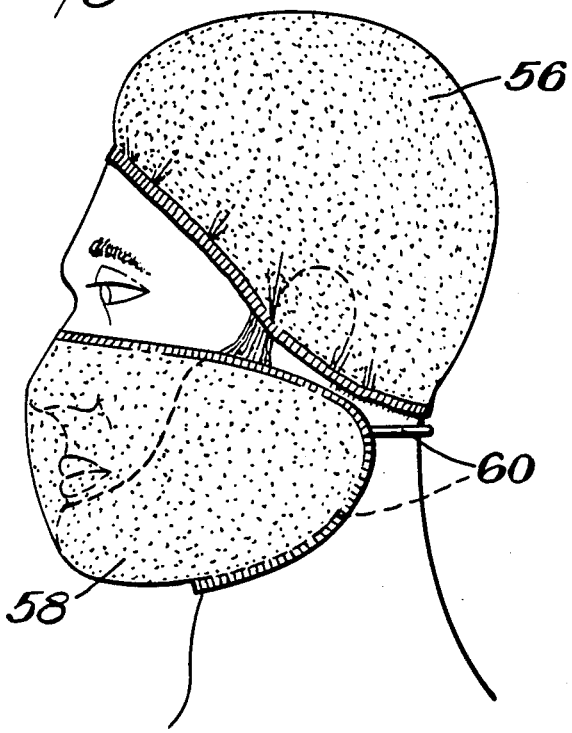
FIG. 11 is a pictorial view of a head and beard cover.

FIG. 11 shows a head covering cap 56 and beard cover 58 having elastic strap 60 which can be used to prevent hair from entering the atmosphere.

Figure 12:
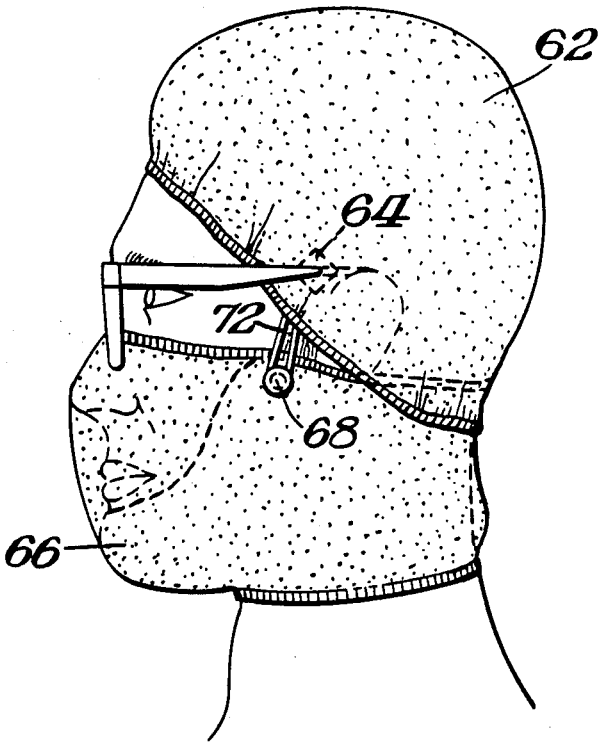
FIG. 12 is a pictorial view of an alternative head and beard cover.

FIG. 12 shows an alternate form of cap 62 and beard cover 66. Cap 62 has a reinforced opening 64 to permit insertion of eyeglasses therethrough. The cap 62 has elastic strap 72 which attaches to button 68 on the beard cover 66 as shown, for support.

Figure 13:
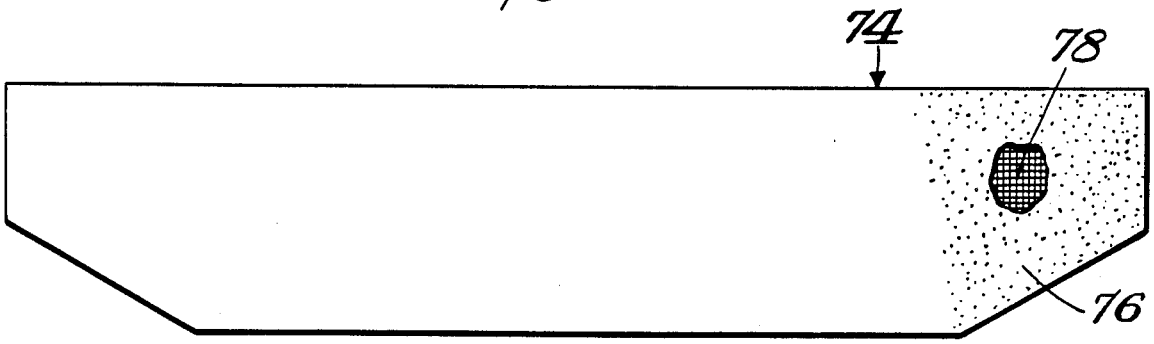
FIG. 13 is a top plan view of a preferred pattern for making the beard cover shown in FIG. 12.

The preferred pattern 74 for beard cover 66 is shown in FIG. 13, with expanded, porous PTFE 76 shown laminated to elastic substrate 78, shown broken away. Top and bottom edges are gathered elastically.

Figure 14:
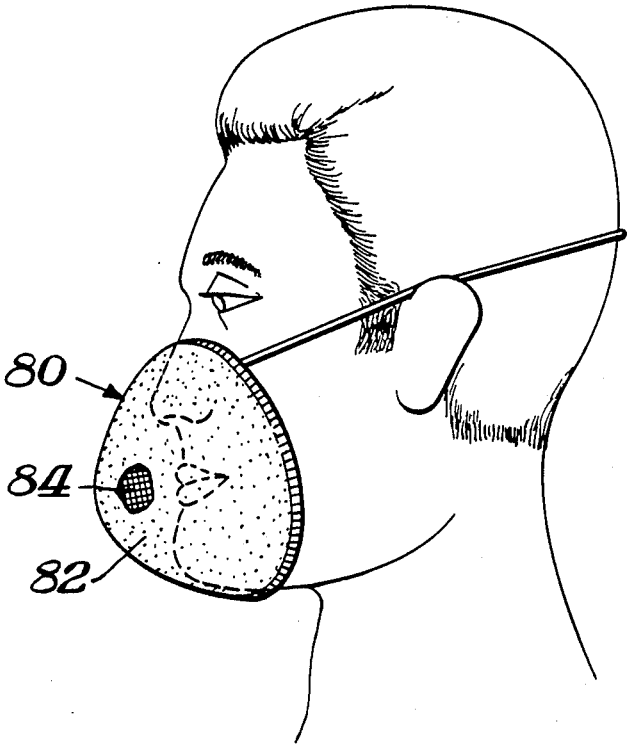
FIG. 14 is a pictorial view of a typical impregnated gas mask, rendered non-linting by a membrane overlay of expanded PTFE.

FIG. 14 shows a mask for limited gas absorption, conventional in design but rendered non-linting by addition of an expanded PTFE membrane overlay 82 sealed at its surface or outer edges to fabric underlay 84.

EXAMPLE 1

The low particle releasing properties of a 100% expanded PTFE membrane garment surface was demonstrated as follows:

Two fabric/expanded PTFE laminates were made. One employed a herringbone weave polyester fabric commonly used in clean room garments, and the other a knit polyester fabric. Both materials were sewn to form closed bags (using 1 square yard of material). Some with only the fabric surface exposed, the others with only the expanded PTFE membrane surface exposed. The bags were then placed in a domestic agitator type washing machine (Maytag) filled with water and washed for 50 hours. This has been found to simulate the abrasion and flexing garments receive in use and thus constitutes an accelerated wear test. This treatment was given the bags so the laminates would be in a condition similar to "in use" rather than "as new". The bags were then cleaned in a standard laundry wash-dry cycle for testing.

The bags were tested for releasable particles by tumbling them inside a slowly turning drum within a Class 100 clean room. The air inside the drum was sampled at the rate of 1 cubic foot per minute by an automatic particle counter set to count the number of particles 0.5 micrometers in size and larger. This test is well known in the industry. Typical counts in particles per minute were as follows:

| Laminate | Membrane-Exposed | Fabric-Exposed |
|---|---|---|
| Woven I | 100 | 9,000 |
| Knit | 100 | 13,000 |

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

CHART I
Pore size of conventional garment materials vs. Gore-Tex TM materials

| | |
|---|---|
| GORE-TEX TM two-layer laminate | 0.2 microns |
| Polyester herringbone material | 66 microns |
| Tyvek material | 6–8 microns |

CHART 2
Filtration efficiencies of conventional garment materials vs. GORE-TEX TM garment materials

| | Particle size | |
|---|---|---|
| | 0.1 micron | 0.3 micron |
| GORE-TEX TM laminate | 99.999+% | 99.99+% |
| Polyester herringbone | 7.75% | 9.97% |
| Tyvek | 78.57% | 89.27% |

CHART 3
Effectiveness of various clean room garments

| | Number of particles detected greater than 0.5 microns |
|---|---|
| GORE-TEX TM laminate with cuff system: | 338 |
| GORE-TEX TM laminate without cuff system: | 2875 |
| Polyester herringbone suit | 11722 |
| Tyvek suit | 30339 |

CHART 4
Tensile and tear strengths of tested beard cover material vs. GORE-TEX TM laminate for beard cover

| | Bulk Tensile Strength | Tear Strength |
|---|---|---|
| GORE-TEX TM laminate | 11335 | 4.44 |
| Tested beard cover | 3334 | 1.91 |

What is claimed is:

1. A unitized gas permeable garment system for preventing the entry or exit of particulate matter from the environment to the wearer and vice versa comprising head enclosure means, body enclosure means, hand enclosure means and foot enclosure means, wherein each enclosure means wherever jointed to adjacent enclosure means is jointed to said adjacent enclosure means by a cuff of an elastomeric material which overlaps a cuff of an elastomeric material on said adjacent enclosure means, wherein at least one said enclosure means is gas permeable and constructed such that its exposed external surface comprises porous, expanded PTFE material.

2. The garment system of claim 1 in which all exposed external surfaces comprise porous, expanded PTFE material.

3. The garment system of claim 1 wherein at least one said cuff is made of a laminate comprising expanded, porous PTFE bonded to an elastomeric textile fabric.

4. The garment system of claim 1 wherein at least one said cuff is made of a laminate comprising a composite laminate of porous, expanded PTFE and a polyether-polyurethane bonded to an elastomeric textile fabric.

5. The system of claim 1 wherein said head enclosure means comprises a hood which completely encloses the head of the wearer, the hood having a transparent panel therein for visibility.

6. The system of claim 1 wherein said head enclosure means comprises a hood having an opening therein which partly exposes the face of the wearer, said opening having edges which contact the face of the wearer comprising elastomeric laminated material, thereby providing a seal at said edges.

7. The system of claim 1 wherein said head enclosure means comprises a face mask and a cap.

8. The system of claim 7 wherein said face mask covers the nose, mouth and chin of said wearer.

9. The system of claim 1 wherein said garment material is electroconductive.

10. The system of claim 1 wherein said body enclosure means comprises a smock type of garment.

* * * * *